United States Patent [19]

Morse et al.

[11] 4,030,747

[45] June 21, 1977

[54] SHEET STRUCTURE HOISTING GRIPPER

[75] Inventors: Charles Richard Morse, Anchorage, Alaska; Alan Leslie Ross, Seattle, Wash.

[73] Assignee: Charles Richard Morse, Anchorage, Alaska

[22] Filed: Feb. 20, 1976

[21] Appl. No.: 659,938

[52] U.S. Cl. ..... 294/92; 294/67 BC; 294/81 R

[51] Int. Cl.[2] ..... B66C 1/22

[58] Field of Search ..... 294/15, 67 R, 67 A, 294/67 B, 67 BB, 67 BC, 67 DA, 67 DB, 78 R, 78 A, 81 R, 82 R, 83 R, 90, 91, 92, 101, 104, 106, 110 R; 214/1 P, 1 S, 1 SW

[56] References Cited

UNITED STATES PATENTS

| | | | |
|---|---|---|---|
| 872,112 | 11/1907 | Downey | 294/67 BC |
| 1,326,802 | 12/1919 | Strathern | 294/92 |
| 2,079,240 | 5/1937 | Bruns | 294/92 |
| 2,542,289 | 2/1951 | Robbins | 294/92 X |
| 2,619,372 | 11/1952 | Gardner | 294/92 |
| 2,628,726 | 2/1953 | Schie | 294/110 R X |
| 2,676,838 | 4/1954 | Gardner | 294/104 |
| 2,718,321 | 9/1955 | Westermeyer | 294/67 BB X |
| 2,981,426 | 4/1961 | Casey | 294/92 X |
| 3,519,305 | 7/1970 | Horstketter et al. | 294/101 |

*Primary Examiner*—Johnny D. Cherry
*Attorney, Agent, or Firm*—Robert W. Beach

[57] ABSTRACT

A throat formed between jaws of a rigid bifurcate gripper can be moved horizontally to receive an edge portion of sheet structure. The gripper is freely tiltable so that application of a lifting force to it will effect tilting of the gripper relative to the sheet structure to bind such structure between the jaws. Normally the gripper is positioned by a counterweight with its elongated throat horizontal. The lower jaw is of reflex angle shape and is positioned relative to the upper jaw so that downward tilting of the jaws will cause them to bind the sheet structure in the gripper throat.

17 Claims, 5 Drawing Figures

SHEET STRUCTURE HOISTING GRIPPER

BACKGROUND OF THE INVENTION

1. Field of the Invention

The present invention relates to a gripper for binding engagement with the margin of sheet structure so that such sheet structure can be hoisted.

2. Prior Art

Prior grippers for sheet material have utilized relatively movable jaws or sheet-engaging members. Examples of such devices are shown in the United States Renfroe Pat. Nos. 3,162,476; 3,336,068 and 3,356,406, Kaplan U.S. Pat. No. 2,987,337, Horstketter U.S. Pat. No. 3,519,305 and Foster U.S. Pat. No. 3,837,698.

SUMMARY OF THE INVENTION

It is an object to provide a gripper for use in hoisting a sheet structure such as pipe which can be easily applied to and removed from the structure to be hoisted and which will grip the structure to be hoisted securely.

A further object is to provide a gripper for sheet structure which can be engaged in a single operation with the sheet structure to be hoisted and which does not require any supplemental grip-effecting operation other than the application of a hoisting force.

Another object is to provide gripping mechanism for sheet material having a minimum number of movable parts so that the gripping mechanism will operate reliably in cold weather.

A further object is to provide gripping mechanism for sheet structure which is strong and rugged so as to minimize possiblity of failure during operation and is, therefore, very safe to use.

It is also an object to provide gripping mechanism that can effect a reliable grip on sheet structures of different thicknesses within a reasonable range of variation.

Another object is to provide gripping mechanism which is simple and economical to construct.

An additional object is to provide gripping mechanism which will hold sheet structure securely without marring such structure.

The foregoing objects can be accomplished by use of a rigid bifurcate gripper having jaws spaced to form a throat engageable with sheet structure to be hoisted, and which gripper is pivotally mounted to be tilted to move the jaws into binding engagement with the sheet structure by application of a lifting force to the gripper.

DETAILED DESCRIPTION

Figure 1:
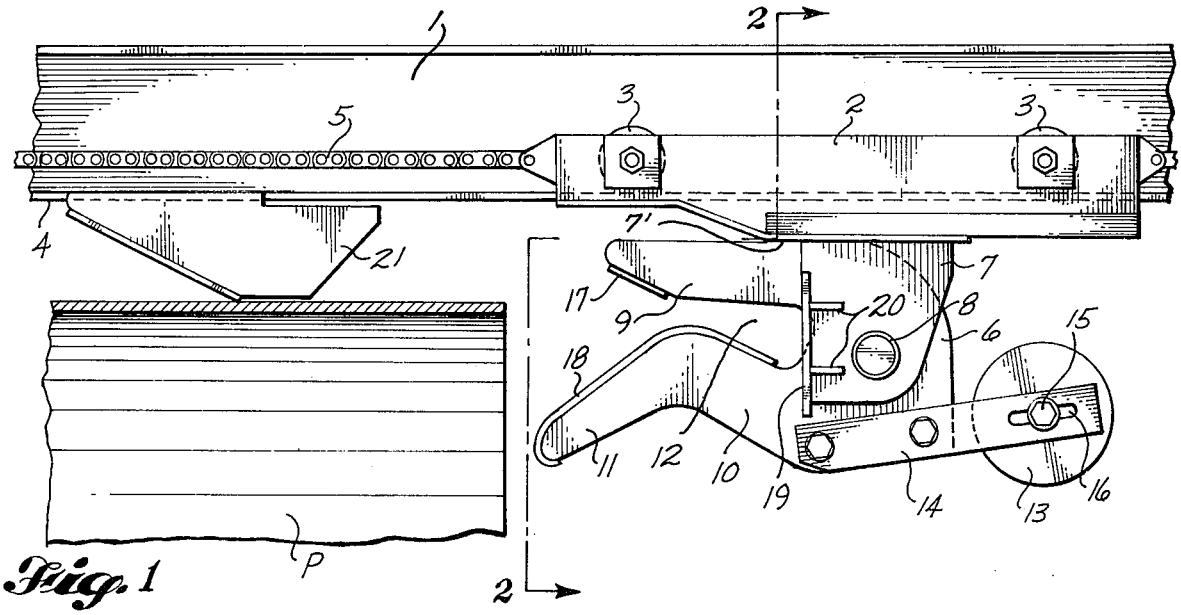
FIG. 1 is a side elevation of the gripping mechanism.

While the gripper of the present invention could be used for hoisting sheet structures of various types, it is particularly useful for hoisting pipe. Such pipe might be 24 inches to 60 inches [60.96 to 152.4 cm.] in diameter, for example, and might be from 20 feet to 100 feet [6 to 30 m.] in length. A gripper can be used to engage the upper side of each end portion of the pipe wall which is of sheet character. FIG. 1, for example, shows such portion of a pipe P that can be engaged by a gripper. Cooperating grippers can be moved lengthwise along a pipe-spanning frame track 1 carried by a pipe-handling crampon apparatus generally of the type shown in copending U.S. patent application Ser. No. 541,264 of Charles R. Morse entitled Pipe-Handling Crampon.

Figure 2:
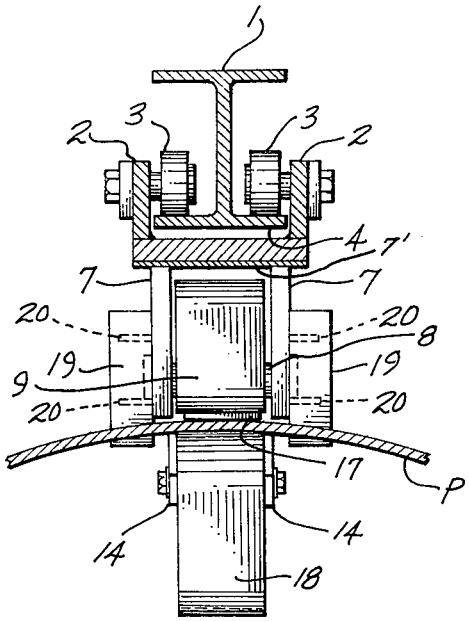
FIG. 2 is a transverse section through such mechanism taken on line 2—2 of FIG. 1.
Figure 4:
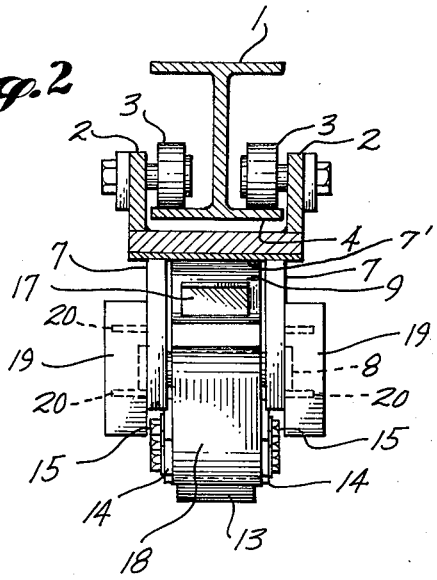
FIG. 4 is a transverse section taken along line 4—4 of FIG. 3.

Each gripper is carried by a carriage 2 supported by wheels 3 on the lower flanges 4 of the I-beam track 1, as shown best in FIG. 2. The carriage is moved longitudinally of the track by a carriage-driving chain 5. Where a gripper is provided to engage opposite ends of a pipe, the carriage-driving chains for the two grippers can be moved oppositely so that the cooperating grippers can be moved simultaneously into engagement with the opposite ends of the pipe. The pipe can then be lifted by hoisting the track 1.

Each gripper 6 is received between the parallel side plates of a straddling frame 7 depending from the carriage 2, and the gripper is supported for tilting relative to such frame by a pivot pin 8 defining a pivot axis extending transversely of the length of track 1 and of the direction in which the carriage moves along such track. The gripper is a bifurcate member having a straight upper counteraction jaw 9 and a lower reflex angle jaw. Such angle jaw includes a root portion 10 having an upper surface convergent toward the tip portion of the upper jaw to the crest of the lower jaw reflex angle and a tip portion 11 having an upper surface divergent from the crest of the lower jaw to its tip away from the upper jaw and forming a ramp for guiding a sheet structure to move into an elongated gripper throat 12 between the jaws. The length of such throat is substantially aligned with the pivot 8 adjacent to the closed end of the throat 12. The angle between the throat surface of the lower jaw root portion 10 and the ramp of the tip portion 11 is obtuse.

The bifurcate gripper 6, including the upper and lower jaws, is a rigid member so that the spacing between the jaws does not change but the jaw spacing forming the elongated throat 12 is not uniform. As shown in FIG. 1, the throat first converges from its closed end toward its mouth to the crest of the lower jaw reflex angle and then diverges to its mouth both because of the divergent character of the lower jaw portion 11 and because the inner surface or undersurface of the tip portion of the upper jaw 9 is inclined away from or divergent from the lower jaw in a direction toward the tip of the upper jaw.

The inclination of the undersurface of the upper jaw tip portion is such that the surface is substantially flat and its plane is substantially parallel to the plane of the upper surface of the root portion 10 of the lower jaw although such surfaces are offset edgewise transversely of the axis of pivot pin 8. Moreover, such parallel planes are quite close together, being spaced apart approximately the thickness of the sheet structure so that it will be gripped between such parallel surfaces by tilting of the gripper around the axis of pivot 8. The gripper is freely tiltable on the pivot pin 8 but normally is held in the position shown in FIG. 1 in which the length of the throat 12 is disposed substantially horizontally and the lower surface of the tip portion of the upper jaw and the upper surface of the tip portion 11 of the lower jaw form approximately equal angles with a horizontal plane through the throat. However, the upper surface of the lower jaw tip portion 11 is longer than the undersurface of the upper jaw tip portion.

The gripper 6 is normally positioned with its length approximately by the force exerted on the gripper by a counterweight 13 carried on the free end of a cantilever arm 14 extending from the body of the gripper in the direction opposite the direction in which the jaws project. Such counterweight can be mounted by a pin 15 slidable transversely along the length of a slot 16 extending lengthwise of arm 14 to enable the torque exerted by the counterweight on arm 14 to be adjusted in magnitude.

Figure 3:
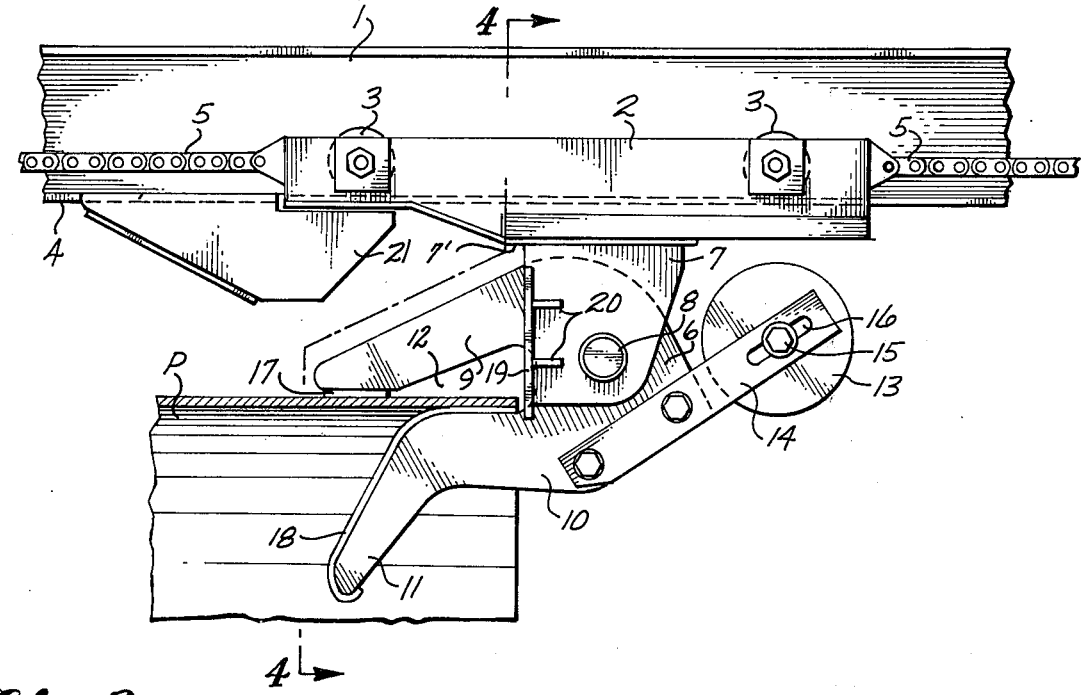
FIG. 3 is a side elevation of the gripping mechanism like FIG. 1 but with parts in different positions.

Upward movement of the mouth of gripper throat 12 effected by tilting of the gripper caused by the torque of the counterweight 13 is limited by engagement of the upper jaw of the gripper with the plate 7' connecting the two parallel side plates of frame 7. When the carriage 2 is pulled toward the end of a pipe P by the carriage-driving chain 5, the upper portion of the pipe end should be in a position so that the mouth of the throat 12 will pass over an end portion of the pipe wall until the crest of the reflex angle lower jaw is well past the end of the pipe, as shown in FIG. 3.

If the track 1 and carriage 2 are raised to lift frame 7 and, therefore, pivot 8, the crest of the lower jaw will bear against the underside of the sheet structure and be prevented from rising farther while the pivot 8 continues to be lifted. Such lifting of the pivot 8 will cause the arrested lower jaw of the gripper to swing downward until the tip portion of the upper jaw 9 is swung into contact with the upper side of the sheet structure, as shown in FIG. 3. At that time, both the lower surface of the tip portion of the upper gripper jaw 9 and the upper surface of the root portion 10 of the lower jaw will bear in substantially full contact with opposite sides of the sheet structure to distribute the gripping pressure over a considerable area, as shown in FIG. 3, in binding the pipe between the jaws.

By such engagement of the upper jaw 9 tip portion with the upper side of the sheet structure, the pressure of the upper surface of the lower jaw root portion 10 cannot tilt the gripper 6 around pivot pin 8 any farther. If a corresponding gripper engagement is effected at the opposite end of the pipe, further lifting of the track 1, carriage 2 and pivot 8 will result in the pipe 0 being lifted by the two grippers at its opposite ends. In order to deter slippage between the grippers and the sheet structure, it is preferred that the inclined tip portion of the upper jaw 9 carry a nonslip pad 17 and the inner side or upper side of the lower jaw 10, 11 carry a nonslip pad or liner 18.

Figure 5:
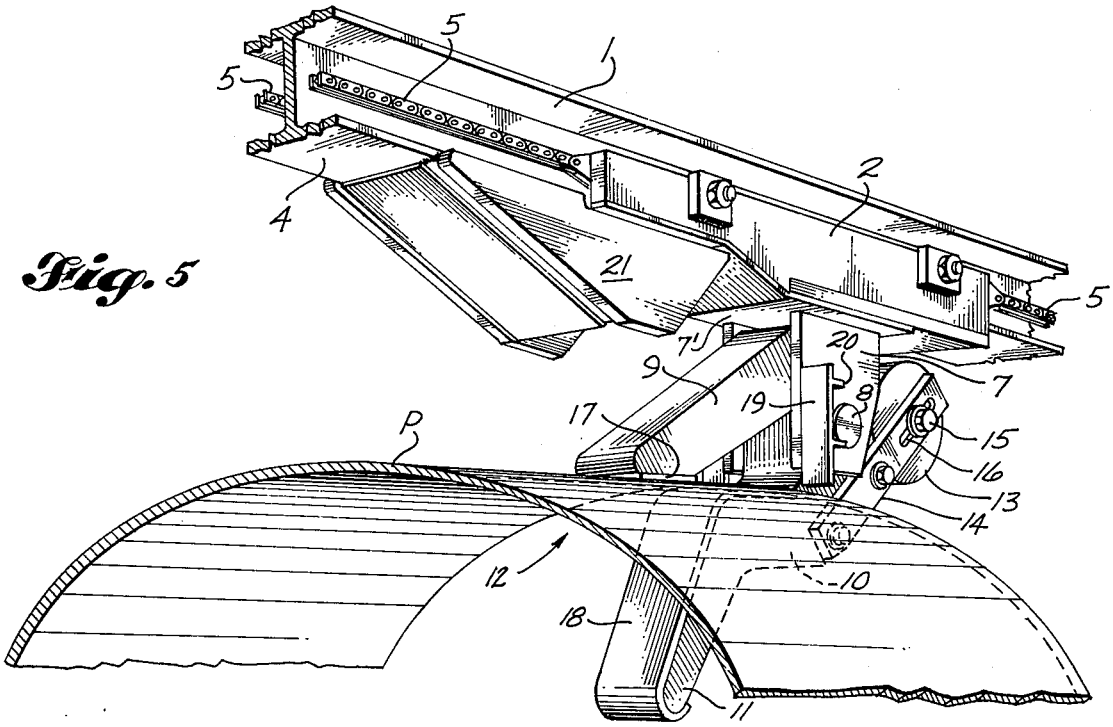
FIG. 5 is a lateral perspective of the gripping mechanism.

Penetration of the edge portion of a sheet structure into the throat 12 is limited by a stop wall 19 mounted on the frame 7 by angle braces 20. Provision of such stop will prevent the thin edge of a sheet structure from wearing away or notching the inner end of the gripper throat by contact with such throat as the gripper swings about pivot 8 relative to the sheet structure from the position of FIG. 1 to the position of FIGS. 3 and 5. The drive mechanism for chain 5 preferably is at least somewhat yieldable so that when the stop 19 comes into engagement with the edge of sheet structure such as the end of a pipe, the chain and its drive mechanism will not strive to push the stop with excessive force against the pipe end.

In order to guide sheet structure such as the end portion of a pipe into the flared mouth of the gripper throat 12 as the carriage 2 is moved toward the pipe end, one or more wedge shaped projections 21 can be provided on the bottom of the rail so that a pipe P and the rail 1 will be wedged apart by interengagement of a guide block 21 and an end of pipe P. The degree of projection of such block is generally equal to the spacing between the mouth of throat 12 of a gripper in released condition and the bottom of the track as shown best in FIG. 1 so the guide block will guide the sheet or pipe end into the mouth of the gripper throat.

As illustrated in FIG. 3, when the gripper has been tilted by lifting pivot pin 8 so that the upper surface of the root portion 10 of the lower jaw and the lower side of the tip portion of upper jaw 9 are pressed firmly into engagement with the root structure, the upper surface of the lower jaw sheet portion 10 is much closer to the axis of pivot pin 8 than the undersurface of the tip portion of upper jaw 9 is to such axis. These distances constitute moment arms and the moments of the pressure times the moment arms must balance about the axis of the pivot pin 8. Since the distance from such axis to the upper side of the lower jaw root portion 10 is considerably less than the distance between the lower side of the tip portion of the upper jaw 9 and the axis of pivot pin 8, the pressure of the upper side of the root portion 10 of the lower jaw against the sheet structure will be considerably greater than the pressure of the underside of the tip portion of upper jaw 9 against the upper side of the sheet structure.

Just as the moments or torques of the upper and lower jaws about the axis of pivot 8 must balance when the gripper is binding the sheet structure, so the forces themselves must balance. Consequently, the difference between the pressures on the upper side of the sheet structure and the pressures on the lower side of the sheet sturcture must be equal to the weight of the sheet structure. The countertorque pressure of the upper jaw on the upper side of the sheet structure can be reduced by increasing the length of the upper jaw 9. It is important, however, that the inclined surface of the tip portion of the upper jaw and the upper surface of the lower jaw root portion 10 be maintained substantially parallel and closely spaced to enable the jaws to bind firmly against opposite sides of the sheet structure when the pivot 8 is lifted while distributing the clamping pressure over the considerable area of the upper jaw surface 17 and the portion of the lower jaw surface 18 inwardly of the lower jaw reflex angle.

We claim:

1. In sheet structure handling mechanism including lifting means and gripping means carried by the lifting means for lifting engagement with a sheet structure, the gripping means including a rigid bifurcate gripper having an upper jaw and a lower jaw forming an elongated throat therebetween engageable with the sheet structure and having a closed end and pivot means supporting the gripper for free tilting relative to the lifting means effected by downward force exerted on the gripper by the weight of the sheet structure, which tilting binds the gripper to the sheet structure, the improvement comprising the pivot means being adjacent to the closed end of the throat and substantially aligned with the length of the throat, the gripper lower jaw being longer than the gripper upper jaw, and the gripper lower jaw having an upper surface of reflex angular shape including a root portion convergent away from the pivot means toward the upper jaw and a tip portion divergent from the root portion away from the upper jaw and forming a ramp leading into the gripper throat, said root portion upper surface and said tip portion upper surface forming an obtuse angle therebetween.

2. In the mechanism defined in claim 1, means for aligning the throat with the sheet structure, and means for effecting relative movement of the gripper and the sheet structure toward each other lengthwise of the throat for moving the sheet structure up the ramp into the gripper throat.

3. In the mechanism defined in claim 2, the elongated gripper throat extending generally horizontally, and the moving means including drive means effecting substantially horizontal movement of the gripper for advancing the throat toward an edge of the sheet structure.

4. In the mechanism defined in claim 1, the tip portions of the jaws flaring away from the gripper throat.

5. In the mechanism defined in claim 1, the upper jaw having an undersurface including a tip portion which portion is spaced farther from the pivot means than the lower jaw root portion, said upper jaw tip portion and the lower jaw root portion being substantially parallel planar surfaces spaced apart perpendicularly a distance substantially equal to the thickness of the sheet structure for engaging opposite sides of the sheet structure over a substantial area when the gripper is tilted relative to the lifting means to grip the sheet structure.

6. In the mechanism defined in claim 5, a nonskid pad on one of the substantially parallel planar surfaces.

7. In sheet structure handling mechanism including lifting means and gripping means carried by the lifting means for lifting engagement with a sheet structure, the gripping means including a bifurcate gripper forming a throat engageable with the sheet structure and pivot means supporting such gripper for free tilting relative to the lifting means effected by downward force exerted on such gripper by the weight of the sheet structure, which tilting binds the gripper to the sheet structure, the improvement comprising the gripper throat being elongated and having a closed end, the pivot means being adjacent to said closed end of the throat and substantially aligned with the length of the throat, and positioning means for normally holding the gripper in a position in which its elongated throat is substantially horizontal.

8. In the mechanism defined in claim 7, the positioning means being a counterweight carried by the gripper at the side of the pivot means opposite the throat.

9. In the mechanism defined in claim 7, means for aligning the throat with the sheet structure, and means for effecting relative movement of the gripper and the sheet structure toward each other lengthwise of the throat for moving the sheet structure into the gripper throat.

10. In the mechanism defined in claim 9, the moving means including drive means effecting substantially horizontal movement of the gripper for advancing the throat toward an edge of the sheet structure.

11. In sheet structure handling mechanism including lifting means and gripping means carried by the lifting means for lifting engagement with a sheet structure, the gripping means including a bifurcate gripper forming an elongated throat engageable with the sheet structure and pivot means supporting such gripper for free tilting relative to the lifting means effected by downward force exerted on such gripper by the weight of the sheet structure, which tilting binds the gripper to the sheet structure, the improvement comprising elongated rigid guide means extending generally parallel to the gripper throat, and means for effecting movement of the gripper along said guide means toward the sheet structure.

12. The mechanism defined in claim 11, and a guide block carried by the rigid guide means and engageable by the sheet structure for locating the sheet structure substantially in alignment with the gripper throat.

13. The mechanism defined in claim 11, and means for shielding the closed end of the gripper throat from engagement with the sheet structure.

14. In sheet structure handling mechanism including lifting means and gripping means carried by the lifting means for lifting engagement with a sheet structure, the gripping means including a bifurcate gripper having an upper jaw and a lower jaw forming an elongated throat therebetween engageable with the sheet structure and pivot means supporting such gripper for free tilting relative to the lifting means effected by downward force exerted on such gripper by the weight of the sheet structure, which tilting binds the gripper to the sheet structure, the improvement comprising the upper jaw having an undersurface including a tip portion and the lower jaw having an upper surface including a root portion, said upper jaw tip portion being spaced farther from the pivot means than said lower jaw root portion, and said upper jaw tip portion and said lower jaw root portion being substantially parallel planar surfaces spaced apart perpendicularly a distance substantially equal to the thickness of the sheet structure for engaging opposite sides of the sheet structure over a substantial area when the gripper is tilted relative to the lifting means to grip the sheet structure.

15. In the mechanism defined in claim 14, a nonskid pad on one of the substantially parallel planar surfaces.

16. In sheet structure handling mechanism including lifting means and gripping means carried by the lifting means for lifting engagement with a sheet structure, the gripping means including a bifurcate gripper having an upper jaw and a lower jaw forming an elongated throat therebetween engageable with the sheet structure and having a closed end and pivot means support such gripper for free tilting relative to the lifting means effected by downward force exerted on such gripper by the weight of the sheet structure, which tilting binds the gripper to the sheet structure, the improvement comprising the pivot means being adjacent to the closed end of the throat, the gripper lower jaw having an upper surface of reflex angular shape including a root portion convergent away from the pivot means toward the upper jaw and a tip portion divergent from the root portion away from the upper jaw, and means for normally holding the gripper in a position in which its elongated throat is substantially horizontal.

17. In the mechanism defined in claim 16, the positioning means being a counterweight carried by the gripper at the side of the pivot means opposite the throat.

* * * * *

UNITED STATES PATENT OFFICE

CERTIFICATE OF CORRECTION

Patent No. 4,030,747 Dated June 21, 1977

Inventor(s) Charles Richard Morse and Alan Leslie Ross

It is certified that error appears in the above-identified patent and that said Letters Patent are hereby corrected as shown below:

Column 6, line 45, cancel "support" and insert --supporting--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*